United States Patent [19]

Townsend et al.

[11] 3,985,159

[45] Oct. 12, 1976

[54] HEDDLE TRANSFER APPARATUS AND METHOD FOR TRIAXIAL WEAVING MACHINE

[75] Inventors: Franklin L. Townsend; Frank P. Trumpio, both of Rockford, Ill.

[73] Assignee: Barber-Colman Company, Rockford, Ill.

[22] Filed: Oct. 7, 1975

[21] Appl. No.: 620,332

[52] U.S. Cl. ..... 139/11; 139/DIG. 1; 139/48

[51] Int. Cl.[2] ..... D03D 41/00

[58] Field of Search ..... 139/1, DIG. 1, 11, 35, 139/48, 49, 50, 55; 66/66, 69, 85

[56] References Cited

UNITED STATES PATENTS

| | | | |
|---|---|---|---|
| 550,068 | 11/1895 | Crompton | 139/11 |
| 1,368,215 | 2/1921 | Stewart | 139/11 |
| 1,752,804 | 4/1930 | Nicolet | 139/11 |

*Primary Examiner*—Henry S. Jaudon
*Attorney, Agent, or Firm*—Bell, Seltzer, Park & Gibson

[57] ABSTRACT

A weaving machine and method for making triaxial fabrics in which a plurality of elongate heddles arranged in weftwise rows guide respective warp strands, and are transferred between weftwise rows. In accordance with this invention, mechanism for engaging heddles and for moving the same and guides extending from one end of one row to an adjacent end of another row cooperate so that heddles are engaged and moved by the mechanism and transferred between the rows. Mechanisms and guides are disclosed for accommodating transfer of heddles between substantially opposing weftwise rows lying substantially in a common plane and between substantially opposing weftwise rows spaced warpwise one from another.

29 Claims, 11 Drawing Figures

HEDDLE TRANSFER APPARATUS AND METHOD FOR TRIAXIAL WEAVING MACHINE

The invention relates to weaving machines and methods for making triaxial fabrics in which warp strands are guided by heddles and the heddles are transferred from the end of one weftwise row to the adjacent end of another weftwise row. More particularly, this invention is an improvement over a triaxial weaving machine disclosed and claimed in co-pending United States patent application Ser. No. 603,756, filed Aug. 11, 1975 and owned in common with the present invention.

The heddle transfer apparatus and method described in the aforementioned co-pending application successfully accommodates smooth mechanical operation of a triaxial weaving machine while avoiding undesirable stress and strain. However, as the operating speed of a triaxial weaving machine is increased, in order to desirably increase the production rates of triaxial fabric, the previously proposed arrangement may encounter minor difficulty in assuring a positive control over movement of a heddle. It is an object of this invention to improve heddle transfer apparatus and methods for triaxial weaving machines by accomplishing more positive control over the heddles being transferred. In accomplishing this object of the present invention, guides are provided which extend from one end of one weftwise row of heddles to an adjacent end of another weftwise row of heddles for quiding heddles and mechanisms moving therebetween.

It is a further object of this invention to guidingly move heddles being transferred from one end of a first weftwise row along a predetermined path of travel from the warpwise position of the first row to a spaced warpwise position at the adjacent end of a second row of heddles. With such transfer, it is contemplated that the making of triaxial fabric can occur with elongated heddles arranged in substantially opposing weftwise rows spaced warpwise one from another, so that a wide range of fabric constructions may be produced.

Yet a further object of this invention is to provide for cooperation of an elongate heddle having a peripheral longitudinal edge and a cut-out adapted to be engaged for imparting longitudinal movement to the heddle with a heddle engaging surface and a rib forming portion of a guide means. By the cooperation of a heddle, heddle engaging surface and rib during movement of a heddle from one end of one weftwise row to an adjacent end of another substantially opposing weftwise row, stress otherwise possibly applied to a warp strand guided by the heddle may be minimized. In accomplishing this object of the present invention, a heddle being transferred is moved laterally while minimizing weftwise displacement of a corresponding warp strand.

Some of the objects of the invention having been stated, other objects will appear as the description proceeds, when taken in connection with the accompanying drawings, in which FIG. 1 is a schematic top plan view of an improved triaxial weaving machine;

Triaxial weaving machines incorporating the improved heddle transfer mechanism and method of this invention will be described more fully hereinafter with particular reference to the accompanying drawings. However, it is to be noted, at the outset of this description, that it is contemplated that this invention may be modified in detail from the illustrated and described structures and methods while obtaining the benefits particularly pointed out. Accordingly, the drawings and descriptions are to be understood broadly as an enabling disclosure of this invention and are not to be taken as restrictive.

The weaving machine embodying the present invention has a plurality of elongate heddles arranged in weftwise rows for guiding, and forming warp sheds of, respective warp strands. The general arrangement and certain operational features of such a weaving machine may be found in drawings and descriptions of co-pending United States patent applications Ser. Nos. 582,246 filed May 30, 1975; and 603,657 and 603,756 filed Aug. 11, 1975, all owned in common with this invention. To the extent that the description and illustration of structures and methods there given are necessary for a full and complete understanding of the present invention, such co-pending applications are hereby incorporated by reference into this description.

Figure 2:
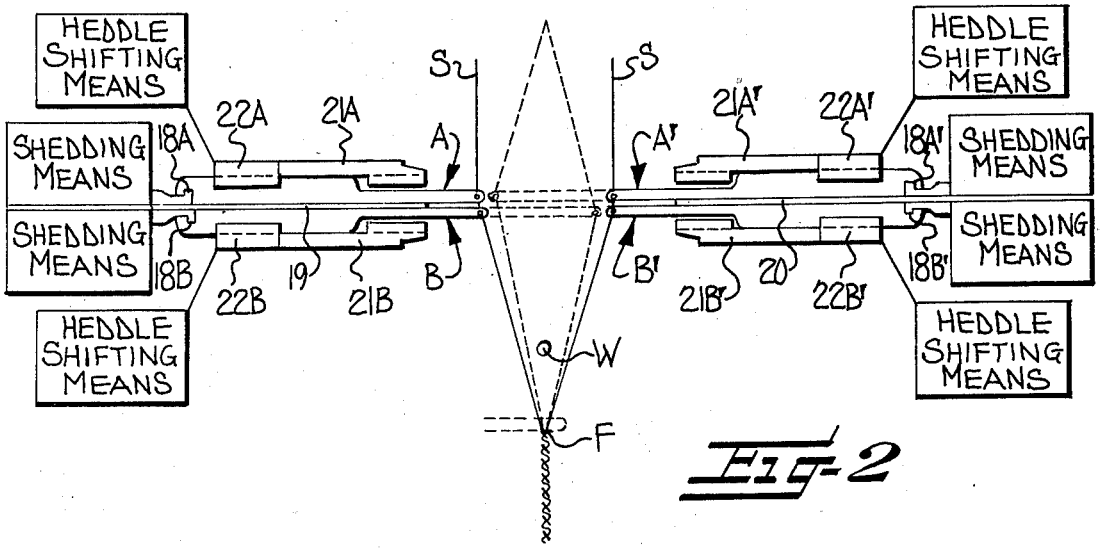
FIG. 2 is a partly schematic end elevation view of the triaxial weaving machine of FIG. 1.

As is known, a weaving machine may include any desired number of weftwise rows of heddles, just so long as at least two such rows are provided. The accompanying drawings illustrate four substantially opposing weftwise rows of heddles A, A′, B, B′ with the upper rows A, A′ constituting a first set or pair of substantially opposing weftwise rows of heddles and the lower rows B, B′ constituting a second set or pair of substantially opposing weftwise rows of heddles. In preferred embodiments of weaving machines incorporating this invention, the weftwise rows of heddles occupy substantially horizontal positions with the heddles moving longitudinally and horizontally to and between extended and retracted positions to form warp strands S guided thereby into warp sheds for the insertion of wefts (FIG. 2). A weft inserting means W inserts wefts into sheds in the horizontal plane and at a location spaced below the levels of the rows of heddles. The fell F of the triaxial fabric being made extends substantially horizontally and is spaced substantially below the rows of heddles A, A′, B, B′. The fabric formed at the fell F moves downwardly in a substantially vertical path during weaving, with suitable beating up means (not shown) serving to beat up each successive inserted weft against the fell and operating in timed relation to the operation of the rows of heddles A, A', B, B' and the weft inserting means W. As will be understood, the direction of movement of fabric during weaving may be upward, horizontal, or in any desired angular direction without departing from the present invention.

Each heddle 10 may be of substantially the type disclosed in co-pending application Ser. No. 582,246, filed May 30, 1975 and owned in common with the present invention. As there disclosed, each heddle 10 is of elongate form, relatively thin and comprises an elongate body portion 11 of a predetermined width, with an elongate, narrow, reduced width frontal portion 12 extending forwardly from the body portion 11. The reduced width frontal portion 12 terminates in a substantially rounded or substantially semi-circularly shaped free end defining a nose portion of the respective heddle. Each heddle has a strand guide opening or eye 14 therethrough closely adjacent the free front end thereof for guidingly engaging a respective warp strand. Preferably, opposite longitudinal edges of a heddle extend substantially parallel to each other, and the body portion 11 defines a projecting shoulder portion adapted to be engaged for shifting of the row of heddles weftwise during operation of the weaving machine. Each heddle also is provided with means adapted to be engaged for imparting longitudinal shedding movement, preferably in the form of a cut-out partially defined by a hook shaped projection 16 on the rear end of the body portion 11 of each heddle.

The cut-outs in the heddles of each row A, A', B, B' are engaged by elongate rib means 18A, 18A', 18B, 18B' formed on a corresponding shedding bar, there being one shedding bar for moving each respective weftwise row of heddles longitudinally between a retracted position and an extended position. In such movement, proximal longitudinal edges of the heddles in the two first rows A, B slide against respective upper and lower surfaces of a first stationary guide plate 19, and proximal longitudinal edges of the heddles in second rows A', B' slide against respective upper and lower surfaces of a second stationary guide plate 20. The stationary guide plates have a length about equal to the width of the triaxial fabric, and the proximal edges of the plates are spaced apart from each other to provide an adequate opening for the passage of warp strands therethrough and for the formation of warp sheds through operation of the heddles.

For controlling the heddles during formation of warp sheds and for shifting the heddles weftwise, heddle guides defining stationary passageways and heddle shifting means defining moving passageways are provided for each row of heddles A, B, A', B'. Each of the guides defining stationary passageways may take the form of an elongate weftwise guide member or bar 21A, 21A', 21B, 21B' suitably supported so that a surface facing toward the corresponding guide plate is spaced from a guide plate 19, 20 a distance somewhat greater than the width of the reduced width frontal portions 12 of the heddles 10. The surface of each guide bar 21A, 21A', 21B, 21B' adjacent the corresponding stationary guide plate 19, 20 has a plurality of projecting teeth or wall members which define therebetween a weftwise row of passageways for guiding the respective heddles in longitudinal movement to and from open shed retracted and extended positions.

Heddle shifting bars 22A, 22A', 22B, 22B' are provided for shifting each heddle in each row from one passageway to an immediately adjacent passageway to thereby move heddles and warp strands engaged thereby weftwise during weaving so that the warp strands may extend angularly with respect to wefts. Each heddle shifting bar takes the form of an elongate, weftwise extending and weftwise movable bar member positioned rearwardly of and in sliding engagement with, or in close proximity to, a respective stationary heddle guide. Each shifting bar has a weftwise row of closely spaced forwardly and rearwardly extending teeth or wall members which define a weftwise row of passageways for guidingly receiving therein shoulder portion of the heddles during the longitudinal movement thereof from and to the open shed retracted and extended positions. As is brought out more fully in aforementioned co-pending United States patent application Ser. No. 603,657 filed Aug. 11, 1975, longitudinal movement of heddles and weftwise shifting of the bar are coordinated to effect weftwise movement of heddles and warp strands. As is brought out more fully in aforementioned co-pending United States patent application Ser. No. 603,756 filed Aug. 11, 1975, successive heddles are delivered to the ends of weftwise rows for transfer to the adjacent ends of other weftwise rows.

In accordance with the particular invention to be here described and as indicated above, heddle transfer means generally indicated at 50AB, 50BA (FIG. 1) are provided at opposite sides of the weaving machine for transferring successive heddles one end of each row to the adjacent end of another row. In the illustrated embodiments, each successive heddle is transferred from the leading end of each respective row of heddles A, B, A', B' to the adjacent trailing end of a respective substantially opposing row of heddles. Both heddle transfer means 50AB, 50BA may be of substantially the same construction and therefore only the first heddle transfer means 50AB is described in detail hereinafter.

The first heddle transfer means 50AB comprises guide means extending from one end of one row to the adjacent end of another row for guiding heddles moving therebetween and means for engaging heddles and for moving the same from the one end of one row to the adjacent end of another row. Each of the guide means and means for engaging and moving heddles comprises a number of components, as will be described more fully hereinafter.

The guide means comprises a cooperating arcuate stationary rib means 51, 51', a plate 52 defining a heddle engaging surface, and an arcuate cam surface 54, 54' extending from the one end of one row to the adjacent end of another row. As brought out more fully hereinafter, the rib means 51, 51' engages the projecting hook portions 16 of the heddles 10 being transferred, in order to positively control longitudinal positioning of the heddles during transferring. The heddle engaging surface defined by the plate 52 engages peripheral longitudinal side edges of heddles being transferred, for facilitating guidance of the heddles.

Figure 3:
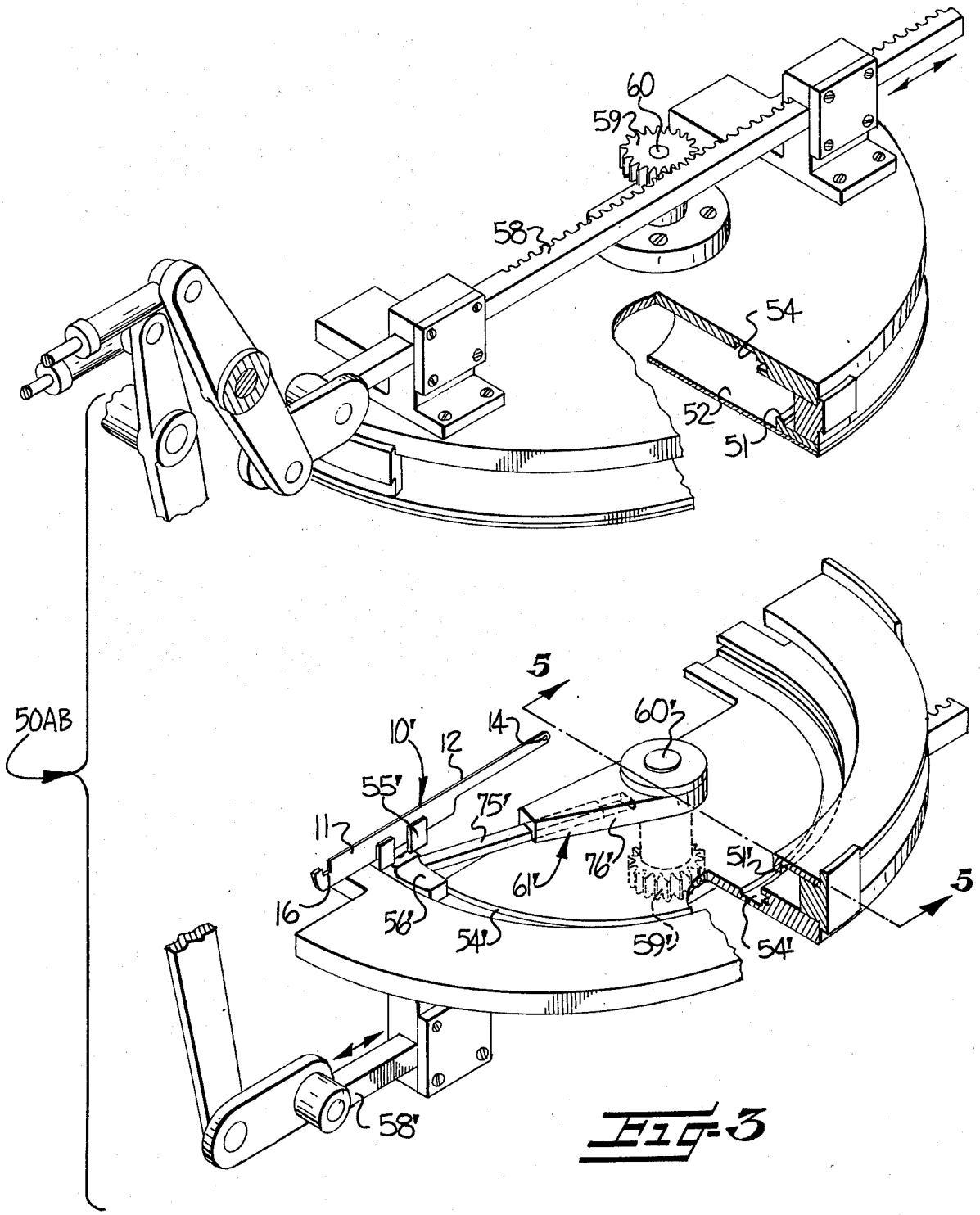
FIG. 3 is an exploded perspective view of a first form of heddle transfer mechanism as useful with the weaving machine of FIG. 1.
Figure 4:
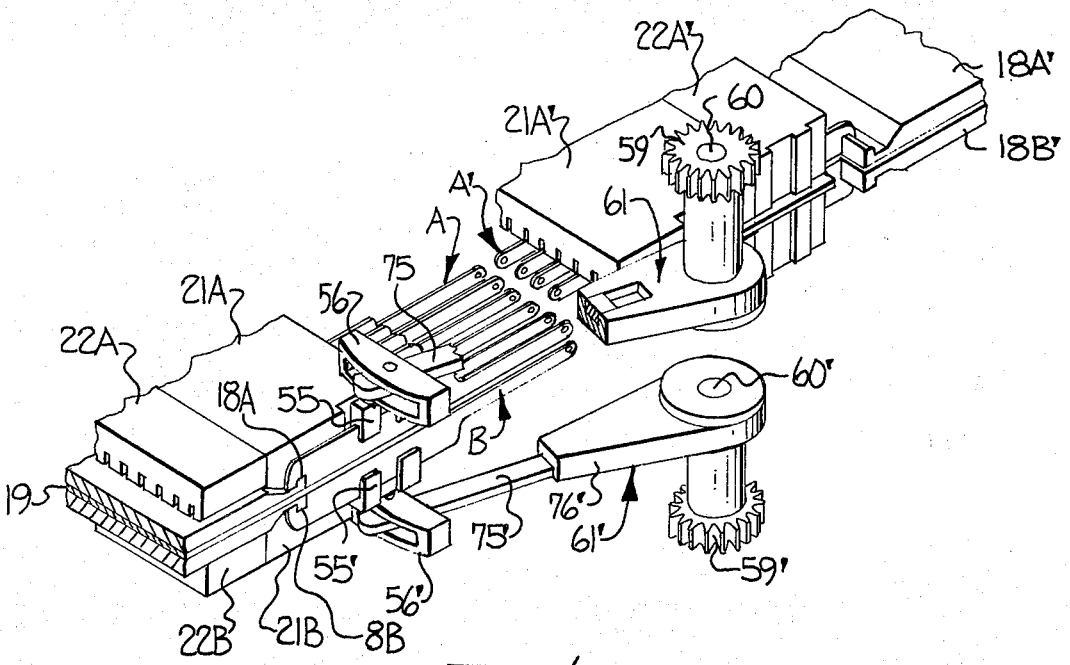
FIG. 4 is a view similar to FIG. 3, particularly illustrating certain elements of the heddle transfer mechanism of FIG. 3.
Figure 5:
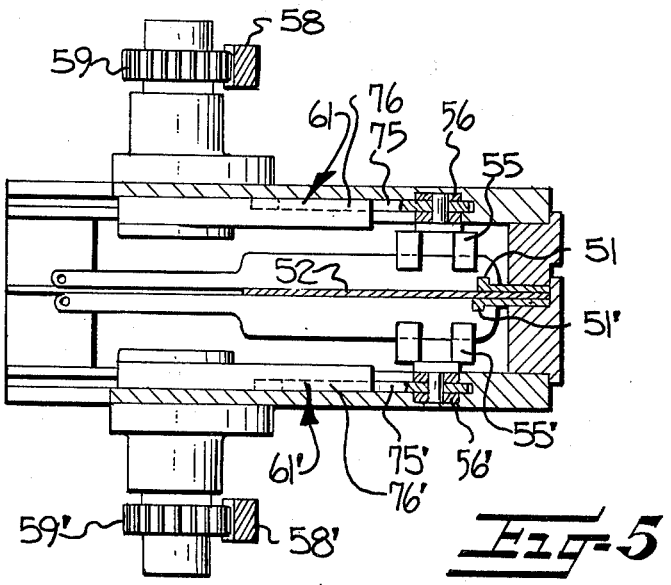
FIG. 5 is a side elevation view, partly in section, of the mechanism of FIGS. 3 and 4, taken substantially along the line 5—5 in FIG. 3.

The means for engaging heddles and for moving the same includes heddle receptacles 55, 55', cam follower means 56, 56' for engaging a respective cam surface 54, 54' and moving therealong, and means for driving a heddle receptacle 55, 55' and corresponding cam follower 56, 56' in oscillation between two weftwise rows of heddles. In the form illustrated, the drive means for each heddle receptacle and cam follower includes a rack gear 58, 58' mounted for longitudinal movement generally parallel to the longitudinal movement of heddles between extended and retracted open shed positions (as indicated by arrows in FIG. 1). Each rack gear 58, 58' engages a corresponding pinion gear 59, 59' mounted for rotation about an axis defined by a driving shaft 60, 60' and offset from the center of the arc defined by the corresponding cam surfaces 54, 54'. Corresponding oscillating arm means 61, 61' interconnect the corresponding driving shaft 60, 60' and each heddle receptacle 55, 55' (FIG. 4). Thus, with oscillation of the rack gears 58, 58' (as indicated by arrows in FIGS. 1 and 3) in timed relation to other functions of the weaving machine, the heddle receptacles 55, 55' engagingly receive and transfer heddles.

More particularly, a heddle is moved weftwise to a leading end of one weftwise row A by the cooperation of guide bars and shifting bars 21A, 22A as briefly referred to hereinabove. The heddle receptacle 55 cooperating with the one weftwise row A preferably has a spaced abutment or crenelated configuration which mates with a correspondingly interrupted or crenelated configuration of the leading end of the guide bar 21A so that the receptacle 55 in its limiting position at the leading end of the row A serves to define the endmost passageway of the guide bar 21A. Thus when an endmost heddle is shifted weftwise by the shifting bar 22A, the heddle is aligned with the receptacle 55 and is engagingly received thereby when moved longitudinally toward the extended position by movement of the corresponding shedding bar. As so positioned, the heddle to be transferred has been moved into engagement with the plate 52 defining the heddle engaging surface. Further, the hook-shaped projection of the heddle to be transferred has been brought into alignment with the corresponding stationary rib 51 forming a portion of the guide means in accordance with this invention. As so prepared for transfer, a heddle to be transferred may be withdrawn from the one row A upon rotation of the oscillating arm means 61 away from that row (counterclockwise in FIG. 1; toward the right in FIGS. 3 and 4).

As the heddle to be transferred is withdrawn from the leading end of the one row A, a peripheral longitudinal side edge of the heddle moves along the heddle engaging surface defined by the plate 52. Further, the cut-out of the heddle is transferred from one moving rib means 18A to an arcuate stationary rib means 51 and is guided thereby in an arcuate path centered on the eye 14 of the heddle. Movement of the heddle receptacle 55 is guided by the engagement of the cam follower 56 with the cam surface 54.

A heddle undergoing transfer to the adjacent end of another row A' is guided, by the stationary rib means 51, to a position corresponding to the retracted position of heddles in that row A'. On reaching its limiting position at the trailing end of that row A', the crenelated receptacle 55 mates with the corresponding shifting bar 22A' and serves to define the endmost passageway thereof. At the same time, the cut-out is transferred from the stationary rib means 51 to the rib means 18A' of the corresponding shedding bar. The heddle is removed from the receptacle 55 by movement of the shedding bar toward the heddle extended position, after which the receptacle 55 returns to its limiting position at the leading end of the one row A and the transfer cycle may repeat as required by the overall function of the weaving machine.

Figure 1:
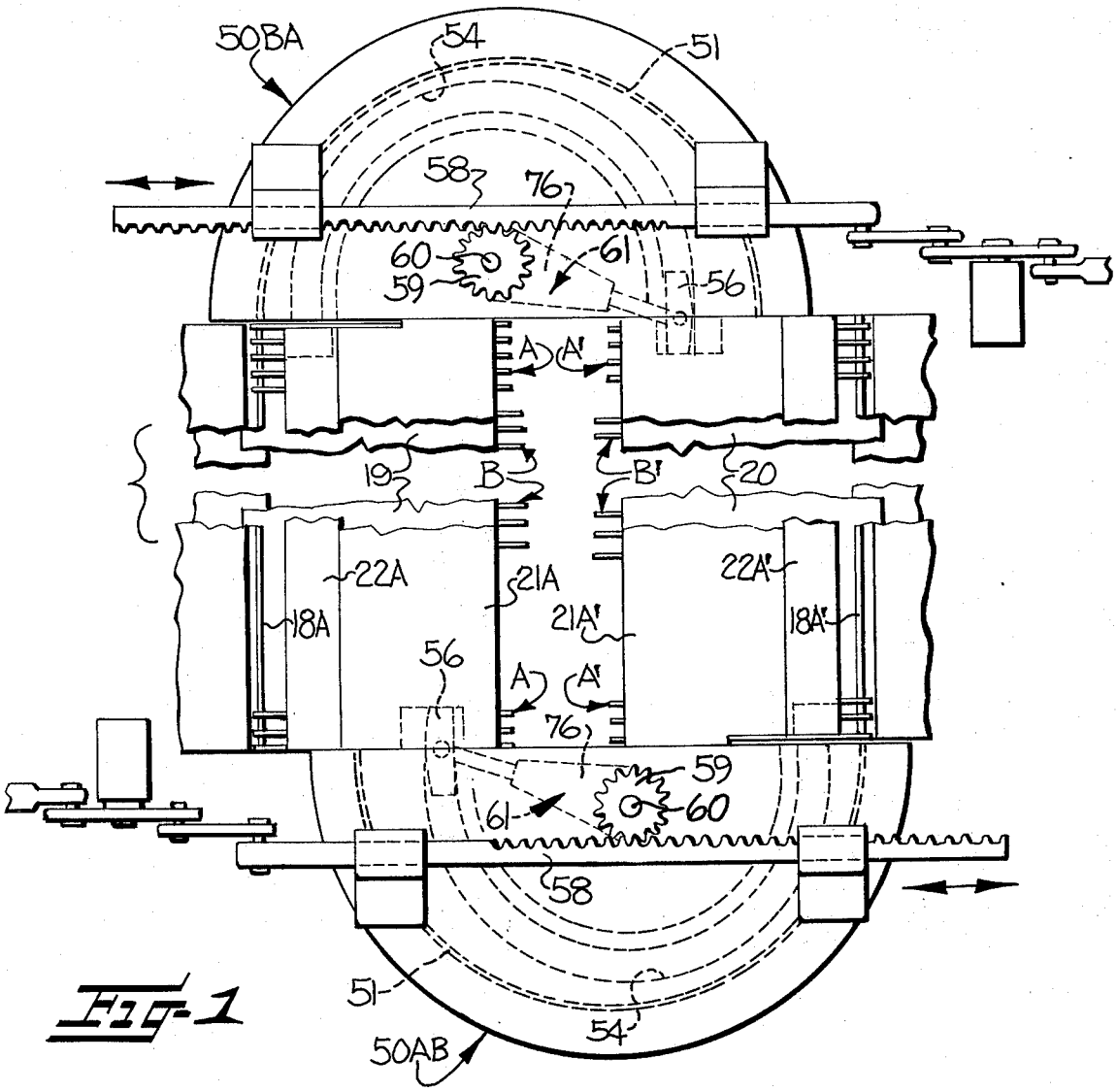

As will be noted from FIG. 1, various components of the guide means in accordance with this invention do not have a common center. Instead, the relationship among the arcuate stationary rib means 51, 51', cam surfaces 54, 54', and oscillating arm means 61, 61' is such that a heddle being transferred is pivoted substantially about the nose portion thereof, so that the heddle is moved as described above from the extended open shed position at the one row toward the retracted open shed position at the other row, while minimizing stress otherwise imposed on the corresponding warp strand by any weftwise movement which might otherwise possibly occur. In the form illustrated, separation of the axis about which the shaft 60, 60' rotates from the pivot location about which the heddle 10 moves (at the eye 14) facilitates avoidance of interference with the corresponding warp strand and with the weft inserting means, but requires the cam surface 54, 54' and cam follower means 56, 56' to assure proper movement of the heddle receptacle 55, 55'. Additionally, such separation requires that the arm means 61, 61' take some form which accommodate lesser and greater distances between the shaft 60, 60' and the cam surface 54, 54' at various relative position of the cam follower means 56, 56' and heddle receptacle 55, 55', such as by being extensible or telescopic.

Figure 6:
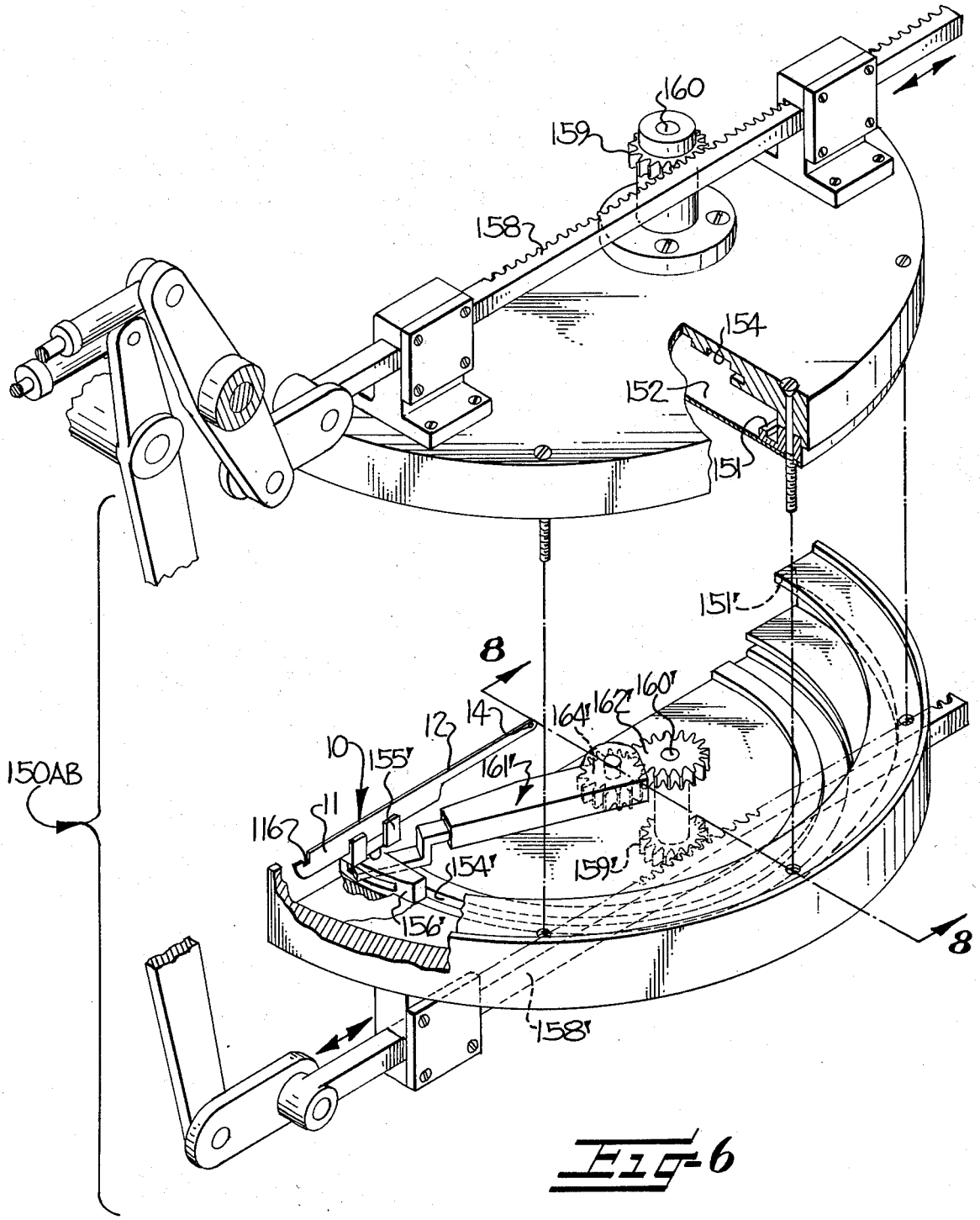
FIG. 6 is a view similar to FIG. 3, illustrating a second form of an improved heddle transfer mechanism.
Figure 7:
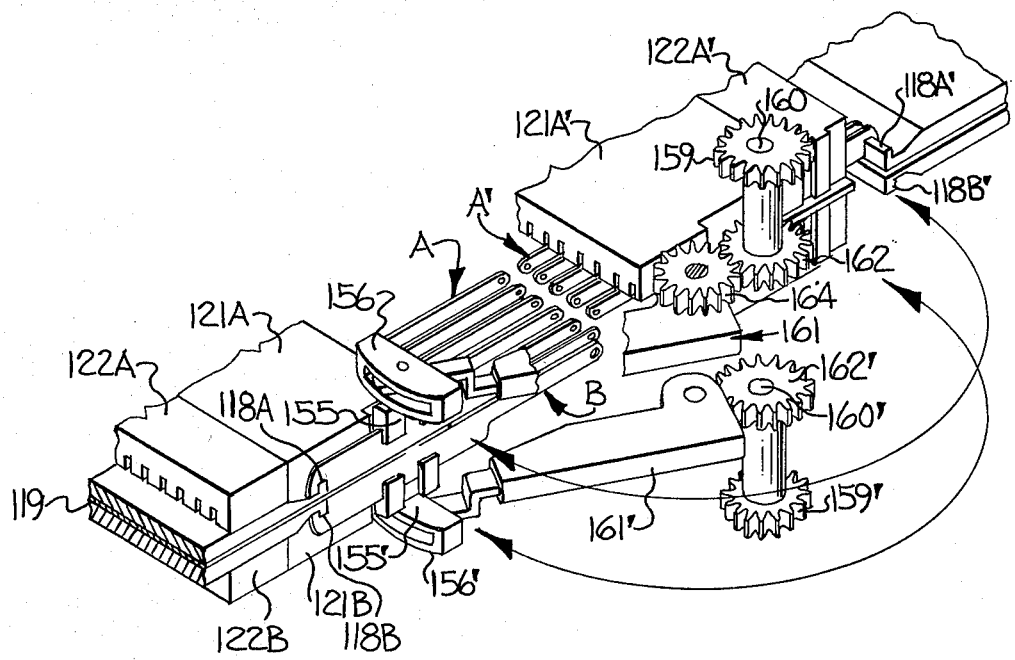
FIG. 7 is a view similar to FIG. 4 of the mechanism of FIG. 6.
Figure 8:
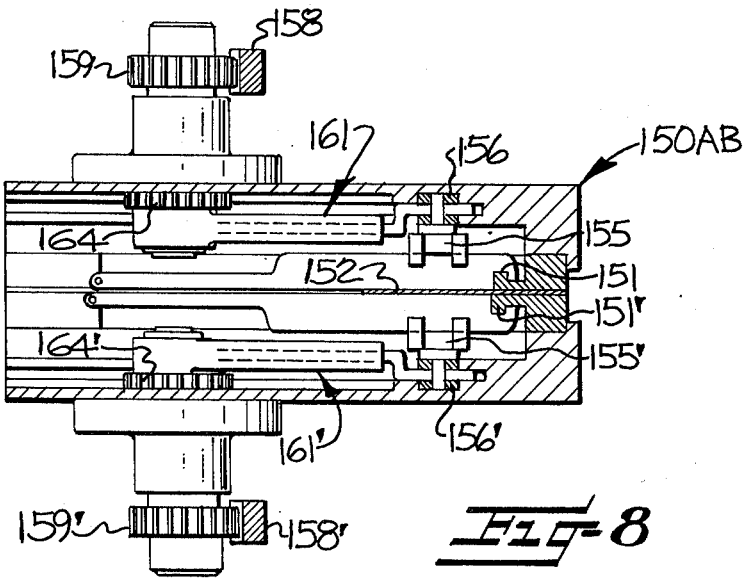
FIG. 8 is a view similar to FIG. 5 of the mechanism of FIG. 6, taken substantially along the line 8-8 in FIG. 6.

A second form of the present invention contemplates an offset between the axis about which the oscillating arm means 61, 61' oscillates, and the axis of the corresponding driving shaft 60, 60'. Such an arrangement is shown in FIGS. 6 through 8 where elements of the apparatus have been identified by reference characters similar to those used for comparable elements in FIGS. 1 through 5 but with the addition of a 100 series designation. There, each oscillating arm means 161, 161' is driven through a gear train including a meshing gear set 162, 162', 164, 164' and moves about a center separated from the axis about which the corresponding shaft 160, 160' oscillates.

Figure 9:
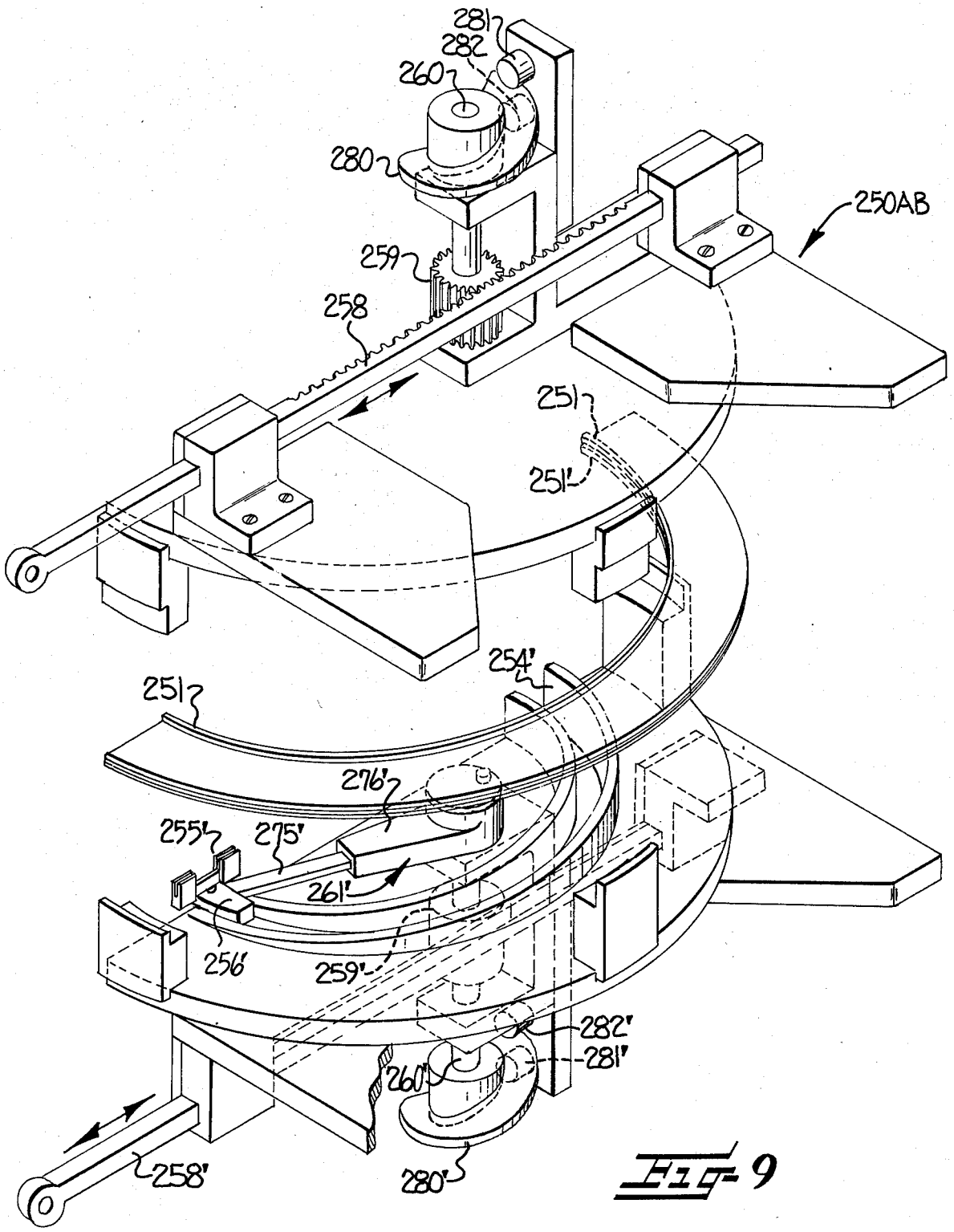
FIG. 9 is a view similar to FIGS. 3 and 6, illustrating a third form of an improved heddle transfer mechanism.

Both of the first and second forms of transfer apparatus in accordance with this invention provide for transfer of heddles between rows which lie substantially in a common plane and incorporate plates 52, 152 in which the heddle engaging surfaces lie substantially in the common plane of the weftwise rows of heddles. The present invention is contemplated as having utility in weaving machines employing substantially opposing weftwise rows of heddles spaced warpwise one from another and a form of the present invention suitable for such weaving machines is illustrated in FIGS. 9 through 11, in which elements corresponding to elements described heretofore have been identified by common reference characters of a 200 series designation.

Figure 10:
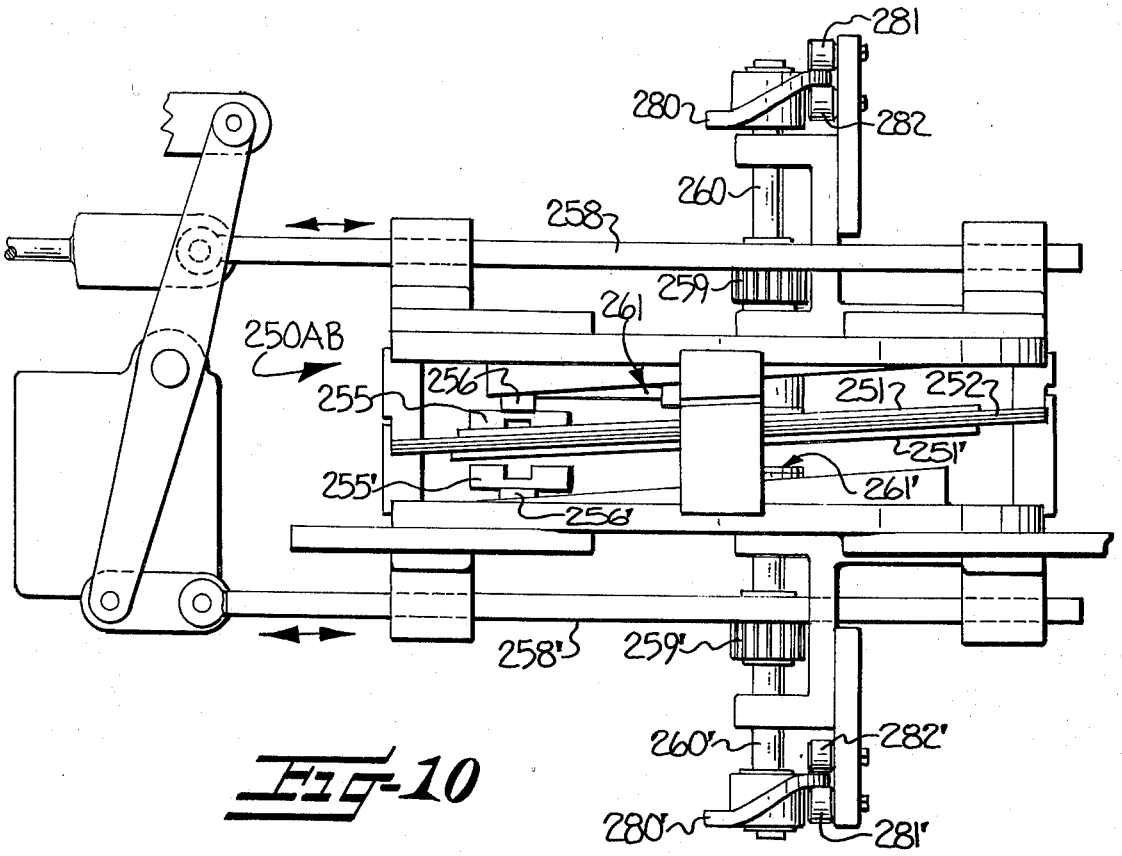
FIG. 10 is an end elevation view of the mechanism of FIG. 9.
Figure 11:
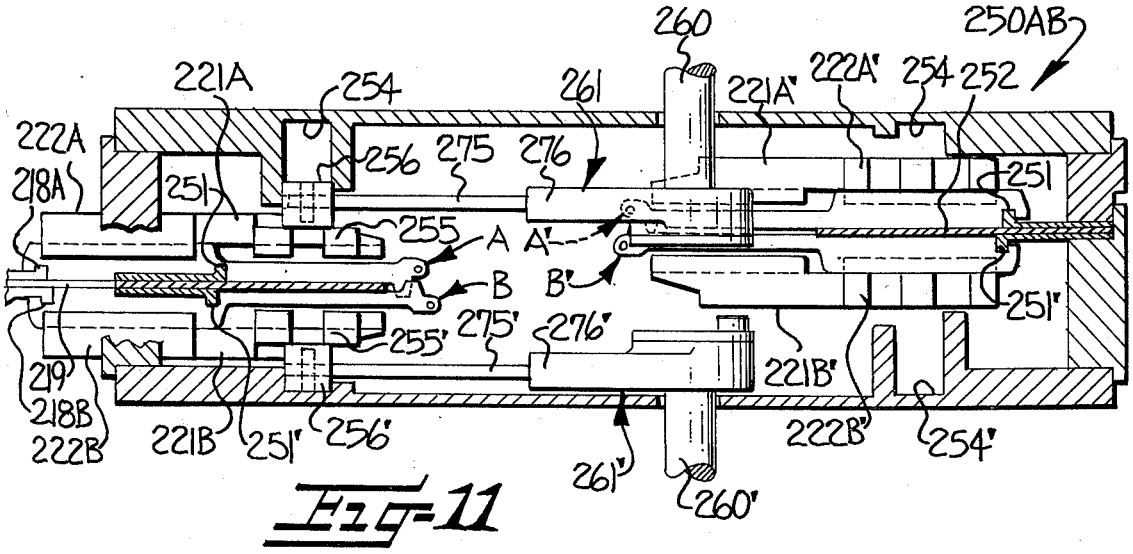
FIG. 11 is an enlarged and elevation view, partly in section, similar to FIG. 10.

As will be noted, the stationary arcuate rib means 251, 251', plate 252 (deleted in FIG. 9 for purposes of clarity), and cam surfaces 254, 25' lie generally on an inclined path between corresponding rows of heddles (FIG. 10). Further, provision is made for shifting the drive shafts 260, 260' longitudinally along respective axes of rotation in timed relation to oscillation of the oscillating arm means 261, 261'. More particularly, the shafts 260, 260' are provided with rotating cam members 280, 280' fixed to corresponding shafts and engaged between a corresponding pair of spaced, stationary cam following rollers 281, 282, 281', 282'. With rotation of the cams 280, 280' between the cam following rollers, 281, 282, 281', 282', the shafts 260, 260' are moved longitudinally in coordination with the inclined path defined by the guide means in this third form of the present invention. Thus, heddles being transferred are guidingly moved in a predetermined path of travel from the warpwise position at the one end of a first row to a spaced warpwise position at the adjacent end of a second row.

In the drawings and specification, there has been set forth a preferred embodiment of the invention, and although specific terms are employed, they are used in a generic and descriptive sense only and not for purposes of limitation.

That which is claimed is:

1. In a weaving machine for making triaxial fabric and having a plurality of elongate heddles arranged in weftwise rows for guiding respective warp strands, and heddle transfer means for moving heddles from one end of one row to the adjacent end of another row, the improvement in said heddle transfer means which comprises stationary guide means extending from said one end of one row to said adjacent end of another row for guiding heddles moving therebetween, and mechanism for engaging heddles and for moving the same along said guide means from said one end of one row to said adjacent end of another row.

2. A weaving machine according to claim 1 wherein said guide means comprises an arcuate cam surface extending from said one end of one row to said adjacent end of another row and wherein said mechanism for engaging heddles and for moving the same comprises cam follower means for engaging said cam surface and being guided thereby.

3. A weaving machine according to claim 1 wherein said guide means comprises a cam surface extending from said one end of one row to said adjacent end of another row and substantially describing an arc of a circle about a predetermined center and wherein said mechanism for engaging heddles and for moving the same comprises extensible arm means mounted for rotation about an axis spaced from said predetermined center and cam follower means mounted on said arm means for movement therewith and for engaging said cam surface and being guided thereby.

4. A weaving machine according to claim 1 wherein said mechanism for engaging heddles and for moving the same comprises oscillating arm means mounted for rotation about an axis and heddle receptacle means mounted on said arm means for movement therewith and for engagingly receiving a heddle to be transferred.

5. A weaving machine according to claim 1 wherein said mechanism for engaging heddles and for moving the same comprises heddle receptacle means for engagingly receiving a heddle to be transferred and drive means operatively connected to said heddle receptacle means for driving the same in oscillation along said guide means.

6. A weaving machine according to claim 5 wherein said drive means comprises a driving shaft mounted for rotation about an axis perpendicular to said rows of heddles, and arm means operatively coupling said driving shaft and said heddle receptacle means.

7. A weaving machine according to claim 6 wherein said arm means is mounted for rotation about an axis spaced from said driving shaft and said drive means further comprises gear means for interconnecting said driving shaft and said arm means.

8. A weaving machine according to claim 1 wherein said rows of heddles between which heddles are transferred lie substantially in a common plane and said guide means comprises a heddle engaging surface lying substantially in said common plane.

9. A weaving machine according to claim 1 wherein said rows of heddles between which heddles are transferred are spaced warpwise one from another and said guide means comprises an inclined heddle engaging surface extending along a path between said rows of heddles.

10. In a weaving machine for making triaxial fabric and having a plurality of elongate heddles arranged in weftwise rows for guiding respective warp strands, each of said heddles having a cut-out therein adapted to be engaged for imparting longitudinal movement thereto, and heddle transfer means for moving heddles from one end of one row to the adjacent end of another row, the improvement in said heddle transfer means which comprises arcuate stationary rib means extending from said one end of one row to said adjacent end of another row for engaging cut-outs of heddles moving therebetween, and means oscillating from and to said one end of the row and said adjacent end of another row for engaging heddles adjacent said one end of one row and for moving engaged heddles along said stationary rib means to said adjacent end of another row.

11. A weaving machine according to claim 10 wherein said rows of heddles between which heddles are transferred lie substantially in a common plane and said stationary rib means extends substantially in said common plane.

12. A weaving machine according to claim 10 wherein said rows of heddles between which heddles are transferred are spaced warpwise one from another and said stationary rib means extends substantially along an inclined path between said rows of heddles.

13. A weaving machine according to claim 10 wherein said heddle transfer means further comprises a cam surface extending from said one end of one row to said adjacent end of another row in spaced relation from said stationary rib means and further wherein said means for engaging heddles and for moving the same comprises cam follower means for engaging said cam surface.

14. A weaving machine according to claim 10 wherein said weaving machine further has movable rib means for engaging said cut-outs of said heddles and for longitudinally moving said heddles from and to retracted and extending positions for forming warp strands guided by said heddles into warp sheds, and further wherein said stationary rib means is mounted for substantial alignment with one of said movable rib means corresponding with said one row of heddles upon said one movable rib means moving to heddle extended position and for substantial alignment with another of said movable rib means corresponding with said another row of heddles upon said another movable rib means moving to heddle retracted position.

15. In a weaving machine for making triaxial fabric and having a plurality of elongate heddles arranged in weftwise rows for guiding respective warp strands, each of said heddles having a longitudinal side edge surface adapted to be engaged for guiding movement thereof, and heddle transfer means for moving heddles from one end of one row to the adjacent end of another row, the improvement in said heddle transfer means which comprises stationary plate means extending from said one end of one row to said adjacent end of another row for engaging peripheral longitudinal side edges of heddles moving therebetween, and means oscillating from and to said one end of one row and said adjacent end of another row for engaging heddles adjacent said one end of one row and for moving engaged heddles along said plate means to said adjacent end of another row.

16. A weaving machine according to claim 15 wherein said rows of heddles between which heddles are transferred lie substantially in a common plane and said plate means has a heddle engaging surface lying substantially in said common plane.

17. A weaving machine according to claim 15 wherein said rows of heddles between which heddles are transferred are spaced warpwise one from another and said plate means has an inclined heddle engaging surface extending along a path between said rows of heddles.

18. A weaving machine according to claim 15 wherein said heddle transfer means further comprises a cam surface extending from said one end of one row to said adjacent end of another row in spaced relation from said plate means and further wherein said means for engaging heddles and for moving the same comprises cam follower means for engaging said cam surface.

19. In a weaving machine for making triaxial fabric and having a plurality of elongate heddles arranged in weftwise rows for guiding respective warp strands, each of said heddles having a cut-out therein adapted to be engaged for imparting longitudinal movement thereto and having a longitudinal side edge surface adapted to be engaged for guiding movement thereof, and heddle transfer means for moving heddles from one end of one row to the adjacent end of another row, the improvement in said heddle transfer means which comprises arcuate stationary rib means extending from said one end of one row to said adjacent end of another row for engaging cut-outs of heddles moving therebetween, stationary plate means extending adjacent said rib means from said one end of one row to said adjacent end of another row for engaging peripheral longitudinal edges of heddles moving therebetween, a stationary cam surface extending from said one end of one row to said adjacent end of another row in spaced relation from said rib means and said plate means, and means oscillating along said cam surface from and to said one end of one row and said adjacent end of another row for engaging heddles adjacent said one end of one row and for moving engaged heddles along said rib means and said plate means to said adjacent end of another row.

20. In a weaving machine for making triaxial fabric and having a plurality of elongate heddles arranged in a pair of substantially opposing weftwise rows for guiding respective warp strands, the rows lying substantially in a common plane; and heddle transfer means for moving heddles from one end of one row to the adjacent end of the other row; the improvement in said heddle transfer means which comprises: guide means extending substantially in said common plane from said one end of one row to said adjacent end of the other row for engaging heddles moving therebetween, and heddle receptacle means oscillating along said guide means from and to said one end of one row and said adjacent end of the other row for engaging heddles adjacent said one end of one row and for moving engaged heddles to said adjacent end of the other row.

21. In a weaving machine for making triaxial fabric and having a plurality of elongate heddles arranged in a pair of substantially opposing weftwise rows for guiding respective warp strands, the rows being spaced warpwise one from another; and heddle transfer means for moving heddles from one end of one row to the adjacent end of the other row; the improvement in said heddle transfer means which comprises: inclined guide means extending along a path from said one end of one row to said adjacent end of the other row for engaging heddles moving therebetween, and heddle receptacle means oscillating along said guide means from and to said one end of one row and said adjacent end of the other row for engaging heddles adjacent said one end of one row and for moving engaged heddles to said adjacent end of the other row.

22. In a weaving machine for making triaxial fabric and having a plurality of rows of elongate heddles arranged in pairs of substantially opposing weftwise rows for guiding respective warp strands, the rows of a pair of opposing rows lying substantially in a common plane; and heddle transfer means for moving heddles from one end of one row of each pair of opposing rows to the adjacent end of the other row of the same pair; the improvement in said heddle transfer means which comprises for each pair of opposing rows: guide means extending substantially in said common plane from said one end of one row to said adjacent end of the other row for engaging heddles moving therebetween, and means oscillating along said guide means from and to said one end of one row and said adjacent end of the other row for engaging heddles adjacent said one end of one row and for moving engaged heddles to said adjacent end of the other row.

23. In a weaving machine for making triaxial fabric and having a plurality of rows of elongate heddles arranged in pairs of substantially opposing weftwise rows for guiding respective warp strands, the rows of a pair of opposing rows being spaced warpwise one from another; and heddle transfer means for moving heddles from one end of one row of each pair of opposing rows to the adjacent end of the other row of the same pair; the improvement in said heddle transfer means which comprise for each pair of opposing rows: inclined guide means extending along a path from said one end of one row to said adjacent end of the other row for engaging heddles moving therebetween, and means oscillating along said guide means from and to said one end of one row and said adjacent end of the other row for engaging heddles adjacent said one end of one row and for moving engaged heddles to said adjacent end of the other row.

24. In a weaving machine for making triaxial fabric and having a plurality of elongate heddles arranged in weftwise rows for guiding respective warp strands, each of said heddles having a warp strand guiding eye and a cut-out, rib means extending weftwise for engaging said cut-outs of heddles in corresponding weftwise rows, means for moving said rib means for moving heddles engaged thereby longitudinally from and to retracted and extended positions and for forming warp strands guided by said heddles into warp sheds, heddle receptacle means mounted for movement to and from positions at one end of one of said weftwise rows of heddles and at an adjacent end of another of said weftwise rows of heddles, means for shifting said heddles weftwise along one of said rib means and into longitudinal alignment with said receptacle means upon the same being positioned at said one end of said one row, said means for moving said rib means moving a heddle engaged by said one rib means and aligned with said receptacle means into said receptacle means upon movement from retracted position to extended position, and means for moving said receptacle means and a heddle being transferred to said adjacent end of said another row, said means for moving said rib means moving a heddle positioned at said adjacent end of said another row out of said receptacle means upon movement from retracted position to extended position, the improvement comprising arcuate stationary rib means mounted for substantial alignment with said one rib means upon movement thereof into position for placement of said heddle in said extended position within said receptacle means and for substantial alignment with another of said rib means upon movement thereof into position for receiving said heddle in said retracted position at said adjacent end of said another row, said arcuate stationary rib means being substantially centered on said guiding eye of a heddle within said receptacle means and cooperating with said receptacle means during movement thereof for moving said cut-out from engagement with said one rib means into engagement with said arcuate stationary rib means, thence therealong with said heddle in substantially radial relation thereto, and thence from engagement with said arcuate stationary rib means into engagement with said another rib means.

25. In a method of making triaxial fabrics in which a plurality of warp strands are guidingly engaged by elongate heddles arranged in weftwise rows, formed into warp sheds by longitudinal movement of the heddles and moved weftwise by shifting of the heddles, the improvement comprising transferring heddles from one end of a first weftwise row to an adjacent end of a second weftwise row by moving the heddles laterally while guiding the heddles by slidably engaging a substantial portion of peripheral longitudinal edges of the heddles with a guiding surface extending from one row to the other.

26. A method according to claim 25 further comprising engagingly straddling a heddle to facilitate moving the same laterally with the peripheral longitudinal edges thereof in slideable engagement with the guiding surface.

27. A method according to claim 25 wherein the heddles have cut-outs formed therein for imparting longitudinal movement thereto and further comprising controlling longitudinal movement of heddles during lateral movement thereof by guidably engaging the cut-outs.

28. A method according to claim 25 wherein the weftwise rows of heddles lie substantially in a common plane and further wherein said moving of heddles while slidably engaging peripheral longitudinal edges thereof comprises maintaining the heddles substantially in the common plane during movement thereof from the first weftwise row to the second weftwise row.

29. A method according to claim 25 wherein the weftwise rows of heddles are spaced warpwise one from another and further wherein said moving of heddles while slidably engaging peripheral longitudinal edges thereof comprises displacing the heddles warpwise during movement thereof from the first weftwise row to the second weftwise row.

* * * * *

UNITED STATES PATENT AND TRADEMARK OFFICE

CERTIFICATE OF CORRECTION

PATENT NO. : 3,985,159

DATED : October 12, 1976

INVENTOR(S) : Franklin L. Townsend et al

It is certified that error appears in the above-identified patent and that said Letters Patent are hereby corrected as shown below:

Column 4, Line 15, "portion" should be --portions--, and delete "the", second occurrence.

Column 5, Line 9, "surfaces" should be --surface--.

Column 6, Line 58, "25'" should be --254'--.

Column 8, Line 50, "extending" should be --extended--.

Signed and Sealed this

First Day of February 1977

[SEAL]

*Attest:*

RUTH C. MASON
*Attesting Officer*

C. MARSHALL DANN
*Commissioner of Patents and Trademarks*